United States Patent [19]

Pinsson et al.

[11] Patent Number: 4,924,994

[45] Date of Patent: May 15, 1990

[54] CHAIN DEPOSIT DEVICE FOR A SHOPPING OR BAGGAGE TROLLEY

[75] Inventors: Daniel Pinsson, Lyons; Bernard Rouesnel, Ecully, both of France

[73] Assignee: Ronis S.A., Courbevoie, France

[21] Appl. No.: 160,311

[22] Filed: Feb. 25, 1988

[30] Foreign Application Priority Data

Mar. 11, 1987 [FR] France ..... 87 03306

[51] Int. Cl.[5] ..... G07F 17/10; G07F 7/02

[52] U.S. Cl. ..... 194/253; 194/905

[58] Field of Search ..... 194/205, 247, 253, 259, 194/905; 280/33.991, 33.992, 33.994

[56] References Cited

U.S. PATENT DOCUMENTS 1,592,482 7/1926 Falconer ..... 194/247 X
4,474,282 10/1984 Lenander ..... 194/905 X
4,573,564 3/1986 Rheeder et al. ..... 194/905 X
4,635,782 1/1987 Wieth et al. ..... 194/905 X
4,637,507 1/1987 Ricouard et al. ..... 194/905 X
4,691,816 9/1987 Trubiano ..... 194/905 X
4,766,989 8/1988 Maloeuvre et al. ..... 194/905 X

FOREIGN PATENT DOCUMENTS 3508772 10/1986 Fed. Rep. of Germany ..... 194/905

*Primary Examiner*—H. Grant Skaggs
*Assistant Examiner*—Edward S. Ammeen
*Attorney, Agent, or Firm*—Dowell & Dowell

[57] ABSTRACT

A locking device for a shopping trolley which includes a pair of locking levers which normally secure one end of a key which is chained to an adjacent trolley but which are operable to release the key upon insertion of a deposit coin and which levers retain the coin until the key is reinserted within the lock.

2 Claims, 1 Drawing Sheet

CHAIN DEPOSIT DEVICE FOR A SHOPPING OR BAGGAGE TROLLEY

BACKGROUND OF THE INVENTION

The invention relates to a chain deposit device for a shopping or baggage trolley of the type comprising a key mounted on one extremity of a chain the other extremity of which is secured with a trolley, the key co-operating with a coin-operated lock of another trolley to liberate a deposit piece (coin) which it contains while locking the two trolleys to one another, unlocking being effected by introduction of a deposit coin which opens the lock and remains imprisoned therein.

Deposit devices for trolleys have received important application due to the advantages which they bring for stores, railway stations, airports, etc, including: the formation of rows of trolleys available to the users in consideration of a deposit coin which is returnable, clearance of gangways, car-parks and garages, and appreciable reduction of losses of and damage to trolleys.

STATEMENT OF THE PRIOR ART

The known rigid apparatuses, where the key and the lock are in one piece, permit simple utilization but present drawbacks, mainly of bulk and difficulty of fitting. They adapt themselves poorly when the terrain is on a slope.

The known chain deposit devices are not very bulky since they can be mounted on the trolley handle-bar, fitting well on trolleys of different dimensions and their flexibility permits of their use on sloping terrains. However their use in unlocking is complicated by a precise positioning of the deposit coin, delicate introduction of the key and a supplementary operation of a maneuver element.

OBJECT OF THE INVENTION

The present invention aims at creating a new chain deposit device in which unlocking is effected by simple introduction of the coin, and which is furthermore simple and thus economical, light and of low bulk, reliable and strong.

SUMMARY OF THE INVENTION

To this end the deposit device according to the invention is characterized in that the deposit lock comprises two levers each pivoting about an intermediate spindle, one extremity of each lever co-operating with notches formed on a key and the opposite extremity of each lever co-operating with the deposit coin, the levers being subject to the action of a locking tumbler activated by a spring and co-operating with the key.

BRIEF DESCRIPTION OF THE DRAWING

The invention will be clearly understood on reading of the following description given with reference to the accompanying drawing, wherein.

DESCRIPTION OF THE PREFERRED EMBODIMENT

Figure 1:
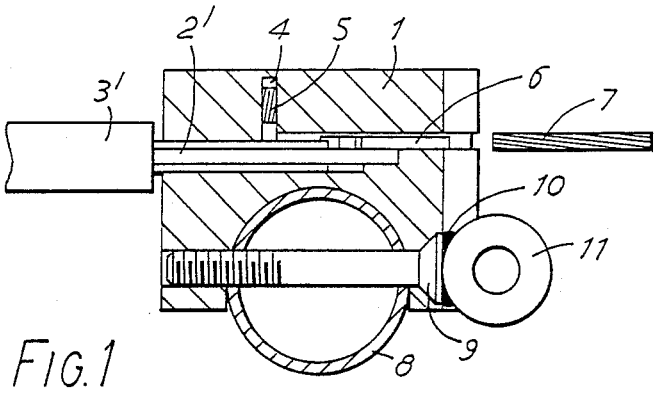
FIG. 1 is an axial sectional view of a deposit device according to one embodiment of the invention, in the position locking upon another identical deposit device.
Figure 2:
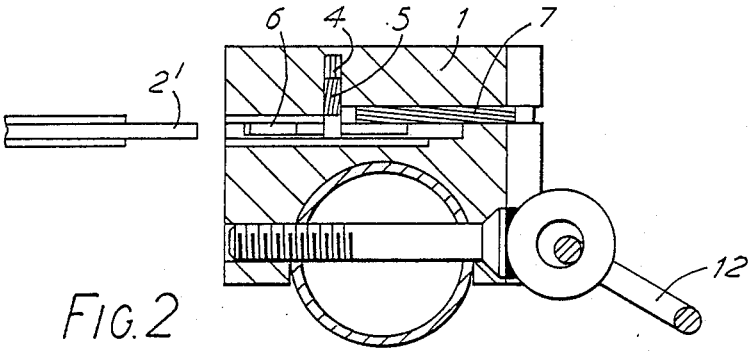
FIG. 2 is analogous with FIG. 1, for the unlocked position.

The deposit device comprises a coin lock comprising a body or casing 1 into which there can penetrate a key 2' provided with a handle 3' and pertaining to an identical deposit device. A spring 4 urges a locking tumbler 5 toward one end 6' of a lever or feeler 6. The one end 6' of the lever and also co-operates with the key 2' and the other or extremity 6'' cooperates or deposit with a coin piece 7 acting as deposit.

The casing 1 is fixed on the handle-bar 8 of a trolley through the intermediary of a through-passing screw 9. A weld 10 connects a ring 11 to the casing 1 and a chain 12 is fixed on the ring 11 and carries at its extremity a key (not shown) identical with the key 2'. The levers or feelers 6 each pivot about a spindle 13.

Figure 3:
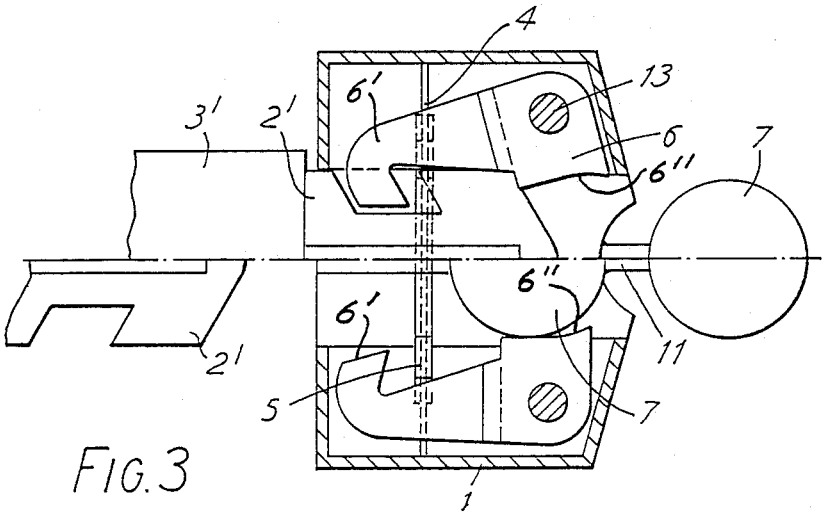
FIG. 3 is a cross-sectional view of the deposit device according to FIGS. 1 and 2, the upper part representing the locked position and the lower part the unlocked position.

The manner of operation is as follows:

In the locked condition (FIG. 1 and top of FIG. 3), the key 2' secured with the previous trolley (not shown) in a rank is held imprisoned by 6' of the lever-feelers 6.

If a coin 7 is introduced into the lock, it actuates the lever-feelers 6 in rotation about the spindles 13, this action liberating the key 2'. By a pull upon the handle-bar 8 of the trolley, the key 2' emerges from the lock, freeing the tumbler 5 which moves into a locking position in alignment with the ends of the lever-feelers 6. The trolley is freed, the coin 7 being retained between the extremities of the levers 6 which are themselves locked by the tumbler 5 being thrust between the ends 6' of the lever-feelers 6 by the spring 4.

It is seen that the device according to the invention, with a very simple structure, permits automatic locking and unlocking of the deposit device.

We claim:

1. In a chain deposit device for a shopping or baggage trolley of the type comprising a key mounted on one extremity of a chain the other extremity of which is secured to a trolley, the key cooperating with a deposit lock of another trolley to liberate a deposit piece which it contains by locking the two trolleys to one another, unlocking being produced by introduction of the deposit piece which opens the lock and remains imprisoned therein, the improvement comprising, forming the deposit lock with two opposing levers each pivoting about an axis, a first end of each lever having means for engaging within notches formed on the key and the opposite end of each lever cooperating to receive the deposit piece therebetween, said key having means to separate said levers, a locking tumbler being movable to a locking position in engagement with said first end of said levers to hold said deposit piece within the deposit lock between said opposite ends of said levers when the key if not inserted between said first ends of said levers of the deposit lock, and spring means for continuously urging said locking tumbler toward said locking position, said locking tumbler being urged from said locking position by the insertion of the key and said first end of said levers being simultaneously separated by the key so that said first ends engage within said notches of the key to thereby pivot said opposite ends about each axis to thereby permit said opposite ends to release the deposit piece.

2. A deposit device according to claim 1 wherein the deposit lock includes a casing, and a chain is provided for connecting the key to said casing of the deposit lock.

* * * * *